US007210323B2

(12) United States Patent
Kruger et al.

(10) Patent No.: US 7,210,323 B2
(45) Date of Patent: May 1, 2007

(54) BINDER APPARATUS FOR SHEET FORMING

(75) Inventors: Gary A. Kruger, Troy, MI (US); Mark G. Konopnicki, Rochester, MI (US); Chongmin Kim, Bloomfield Township, MI (US); John Norman Johnson, Allenton, MI (US)

(73) Assignee: General Motors Corporation, Detroit, MI (US)

( * ) Notice: Subject to any disclaimer, the term of this patent is extended or adjusted under 35 U.S.C. 154(b) by 555 days.

(21) Appl. No.: 10/737,501

(22) Filed: Dec. 16, 2003

(65) Prior Publication Data

US 2005/0126242 A1 Jun. 16, 2005

(51) Int. Cl.
*B21D 26/02* (2006.01)
*B21D 25/00* (2006.01)

(52) U.S. Cl. ..... 72/57; 72/350; 72/63; 29/421.1

(58) Field of Classification Search ..... 72/452.9, 72/452.2, 452.1, 57, 342.7, 296, 297, 342.8, 72/63, 350; 29/421.1
See application file for complete search history.

(56) References Cited

U.S. PATENT DOCUMENTS 4,090,389 A * 5/1978 VAN Denderen et al. .... 72/350
4,754,635 A * 7/1988 van den Berg et al. ..... 72/350
6,880,377 B2 * 4/2005 Kim et al. ..... 72/57
6,886,383 B2 * 5/2005 Kim et al. ..... 72/57
6,910,358 B2 * 6/2005 Schroth ..... 72/57
7,047,779 B2 * 5/2006 Kruger et al. ..... 72/57

* cited by examiner

*Primary Examiner*—David B. Jones
(74) *Attorney, Agent, or Firm*—Kathryn A. Marra

(57) ABSTRACT

A forming apparatus and method for minimizing wrinkling in the forming of a three-dimensional component from a two-dimensional blank. The forming apparatus includes vertically opposed sets of tools or binders. A first tool or binder apparatus has first and second sets of opposed sides having contoured binder surfaces. A second tool or binder apparatus is mounted in vertically opposed relation to the first binder apparatus, and includes first and second sets of opposed tool or binder segments that have contoured binder surfaces thereon that are complementary in shape to the respective binder surfaces of the first and second sets of opposed sides of the first binder apparatus. One of the first and second sets of opposed binder segments of the second binder apparatus have substantially similar contours and the other have different contours. One of the first and second sets of opposed binder segments of the second binder apparatus is elevated and movable with respect to the other.

18 Claims, 4 Drawing Sheets

BINDER APPARATUS FOR SHEET FORMING

TECHNICAL FIELD

The present invention generally relates to a binder apparatus for securing the edges of a sheet metal blank in a sheet forming process, especially a hot blow forming or stretch forming process. More particularly, the present invention pertains to a binder apparatus having sequentially movable sheet gripping segments on one side of the sheet metal blank for stepwise stretching of the sheet metal into a product of complex curvature without uneven thinning, tearing, or wrinkling of the sheet material.

BACKGROUND OF THE INVENTION

In sheet metal stretch forming processes, a hydraulic press machine is often used to support and move opposing forming tools required to form a flat sheet metal blank into a three-dimensional contoured article or product. The press moves the tools from an open position, in which a finished part is removed and a new blank inserted, to a closed position for stretching the sheet metal blank against the tools to form the product. Large presses for shaping large parts typically open and close along a vertical axis. A vertical press, thus, has a lower platen for supporting one of the tools, often a punch or male form tool, and an upper platen for carrying a complementary, opposing tool with a concave cavity, typically a female tool or die. Often the lower platen is raised by a hydraulically actuated ram to close the press. In hot stretch forming, the tools may be individually heated to maintain a suitable forming temperature for the sheet metal blank and the female tool may simply form a closed chamber against an upper surface or side of the sheet metal blank for introduction of a pressurized working gas to stretch the sheet metal blank against the male tool.

In order to stretch the sheet metal blank between the tools, the edges of the sheet metal blank must be gripped so that the interior part of the sheet metal blank is suitably stretched against a forming tool surface. This gripping function is accomplished by opposing binder surfaces. Depending upon the complexity of the shape of the product to be formed, the binding surfaces may be provided on the margins of the opposing tools, or a separate tool sometimes called a binder ring may provided at the margin of a tool to assist the binder function. Such a binder ring may be movable separately from the tool that it surrounds or with which it cooperates.

FIG. 1 illustrates tooling 10 typically used for hot stretch forming of a sheet blank of an aluminum alloy, e.g., AA 5083 formable at elevated temperatures, e.g., about 450° C. Some hot blow forming processes do not require an upper female forming die, but nonetheless include an upper tool 12 for clamping the sheet metal blank (not shown) about its periphery between the upper tool 12 and a lower tool 14. An upper ram of a press (not shown) may carry the upper tool 12, and a lower platen of the press (not shown) may carry a stationary male form die 16 wherein the lower tool 14 encircles the form die 16 and is either separate therefrom or is integral therewith. The lower tool 14 includes laterally opposed ends 18*a*, 18*b*, and laterally opposed sides 20*a*, 20*b*, each having corresponding upper surfaces 22*a*, 22*b*, 24*a*, 24*b*. Likewise, the upper tool 12 includes laterally opposed ends 26*a*, 26*b*, and laterally opposed sides 28*a*, 28*b*, having corresponding lower surfaces 30*a*, 30*b*, 32*a*, 32*b* that correspond in kind to the upper surfaces 22*a*, 22*b*, 24*a*, 24*b* of the lower tool 14.

In operation, the sheet metal blank is placed on top of the contoured surfaces 22*a*, 22*b* of the opposed ends 18*a*, 18*b* of the lower tool 14. Then, the upper ram of the press drives the upper tool 12 toward the lower tool 14, wherein the sheet metal blank is initially held just between the flat lower surfaces 32*a*, 32*b* of the upper tool 12 and the contoured surfaces 22*a*, 22*b* of the lower tool 14. As the upper ram of the press continues to drive the upper tool 12 down, the sheet metal blank is first bent into engagement with the flat surfaces 24*a*, 24*b* of the lower binder 12 and is eventually bent into complete engagement between the contoured surfaces 22*a*, 22*b* of the lower tool 14 and the contoured surfaces 30*a*, 30*b* of the upper tool 12. Thereafter, and in accordance with typical Quick-Plastic-Forming (QPF) processes, heating elements (not shown) in the upper tool 12, lower tool 14, and form die 16 heat the sheet metal blank, and pressurized gas is introduced through a port 34 in the side 28*a* of the upper tool 12. The gas remains pressurized by virtue of a seal created between the upper press platen and an upper surface 36 of the upper tool 12 and by virtue of the seal created by the sheet metal blank which is squeezed between the upper tool 12 and the lower tool 14. As is well-known, the pressurized gas forms the heated sheet metal blank over the form die 16 to create the finished product.

In general, sheet metal that is subjected to a hot gas blow-forming process will undergo thickness reduction, or thinning, depending on factors such as the specific tool surface shape and relative shape and position of the blank. Extreme thinning must be avoided in order for the product to serve its structural purposes. It is also occasionally possible for a complex panel to wrinkle if the blank undergoes compressive stresses sometime during the forming operation. In other words, a finished panel will typically have wrinkles if the surface area of the sheet blank is greater than the final part shape.

In order to avoid the above-mentioned thinning and wrinkling problems, it has been proposed to use more than one forming stage, involving at least one hot blow forming tool. Such an alternative, however, can be cost prohibitive. Also it has been proposed to enlarge an addendum area of the blank, located between the blank holding margin of the blank and the finished component portion of the blank, in order to alleviate the non-uniform stretch condition between the flat clamping surfaces of the lower binder and the contours of the form die. Unfortunately, larger addendum areas increase the size of the blank, thereby leading to increased material costs.

Thus, there is a need to minimize or eliminate wrinkling and thinning conditions in metal forming processes, particularly hot blow forming processes, while avoiding the expense of current solutions to those problems.

SUMMARY OF THE INVENTION

The present invention meets this need by providing an improved binder apparatus for bending a sheet metal blank over a form die. The sheet metal blank has first and second opposed surfaces and is generally rectangular in outline and, thus, has opposite side edges and opposite end edges. Likewise, the form die is generally rectangular in outline with opposite sides and opposite ends and has a forming surface thereon.

The binder apparatus includes a first binder tool that is spaced apart from and that faces a second binder tool that generally circumscribes the form die. The first binder tool is generally rectangular in outline and includes a pair of laterally opposed end portions and a pair of laterally opposed side portions. The end and side portions have binder surfaces thereon that face complementary binder surfaces on the second binder tool.

The second binder tool is generally rectangular in outline and includes a pair of laterally opposed end segments that are positioned alongside the opposite ends of the form die and further includes a pair of laterally opposed side segments positioned alongside the opposite sides of the form die. The end and side segments have the complementary binder surfaces thereon that face the binder surfaces on the first binder tool. The binder surfaces on the end segments are elevated with respect to the binder surfaces on the side segments. In other words, the binder surfaces on the end segments are closer to their complementary binder surfaces on the first binder tool than the binder surfaces on the side segments are to their complementary binder surfaces on the first binder tool. Also, the end segments are separately movable with respect to the side segments in a direction that is substantially perpendicular to the opposed surfaces of the sheet metal blank. Preferably, the binder surfaces on the end segments have substantially similar contours, while the binder surfaces on the side segments have different contours from one another that tend to follow the contours on the respective sides of the form die.

In operation, the sheet metal blank is first preheated to a suitable hot blow forming temperature and is then placed against the elevated binder surfaces on the end segments of the second binder tool. Next, the first binder tool is moved toward the second binder tool such that, initially, only the binder surfaces on the end portions of the first binder tool contact the sheet metal blank. The first binder tool continues its movement toward the second binder tool, thereby bending the sheet metal blank into conformity between the complementary binder surfaces on the end binder portions of the first binder tool and the end segments of the second binder tool. Because of the difference in elevation between the end and side segments of the second binder tool, the first binder tool initially bends the sheet metal blank about the binder surfaces on the end segments before ever driving the sheet metal blank into contact with the side segments. Nonetheless, the first binder tool continues to travel toward its closed position against the second binder tool, thereby displacing the movable end segments and thereby driving the sheet metal blank into contact with the binder surfaces on the side segments of the second binder tool. The first binder tool travels even further toward the second binder tool thereby bending the sheet metal blank about the binder surfaces on the side segments of the second binder tool and simultaneously bending a central portion of the sheet metal blank over the forming surface of the form die until, finally, the sheet metal blank is fully clamped between the binder surfaces on the first and second binder tools. Thereafter, the sheet metal blank may be hot blow formed over the forming surface of the forming die in accordance with one aspect of the present invention.

Accordingly, the sheet metal blank is sequentially locked between the first and second binder tools—first between complementary binder surfaces at opposed ends of the first and second binder tools, and then between complementary binder surfaces at opposed sides of the first and second binder tools. This progressive process results in more gradual bending and closer conformity of the shape of the sheet metal blank with respect to the shape of the forming surface of the forming die. Thus, by using a binder apparatus having elevated and movable end segments and having stationary side segments, with contoured surfaces on all of the segments, metal is more easily stretched over a form die so as to minimize thinning and wrinkling.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

Figure 1:
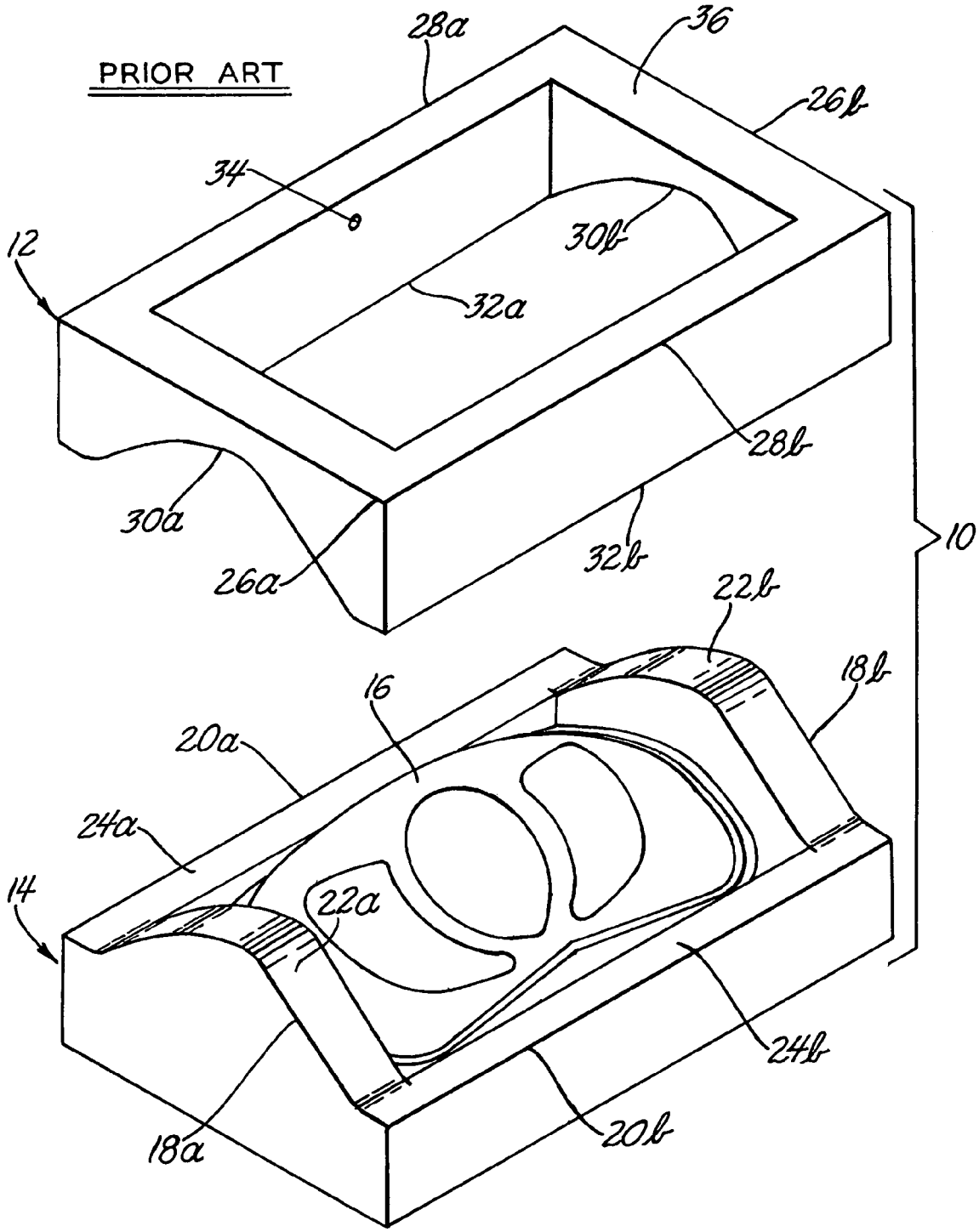
FIG. 1 illustrates a hot stretch-forming apparatus in accordance with the prior art.
Figure 2:
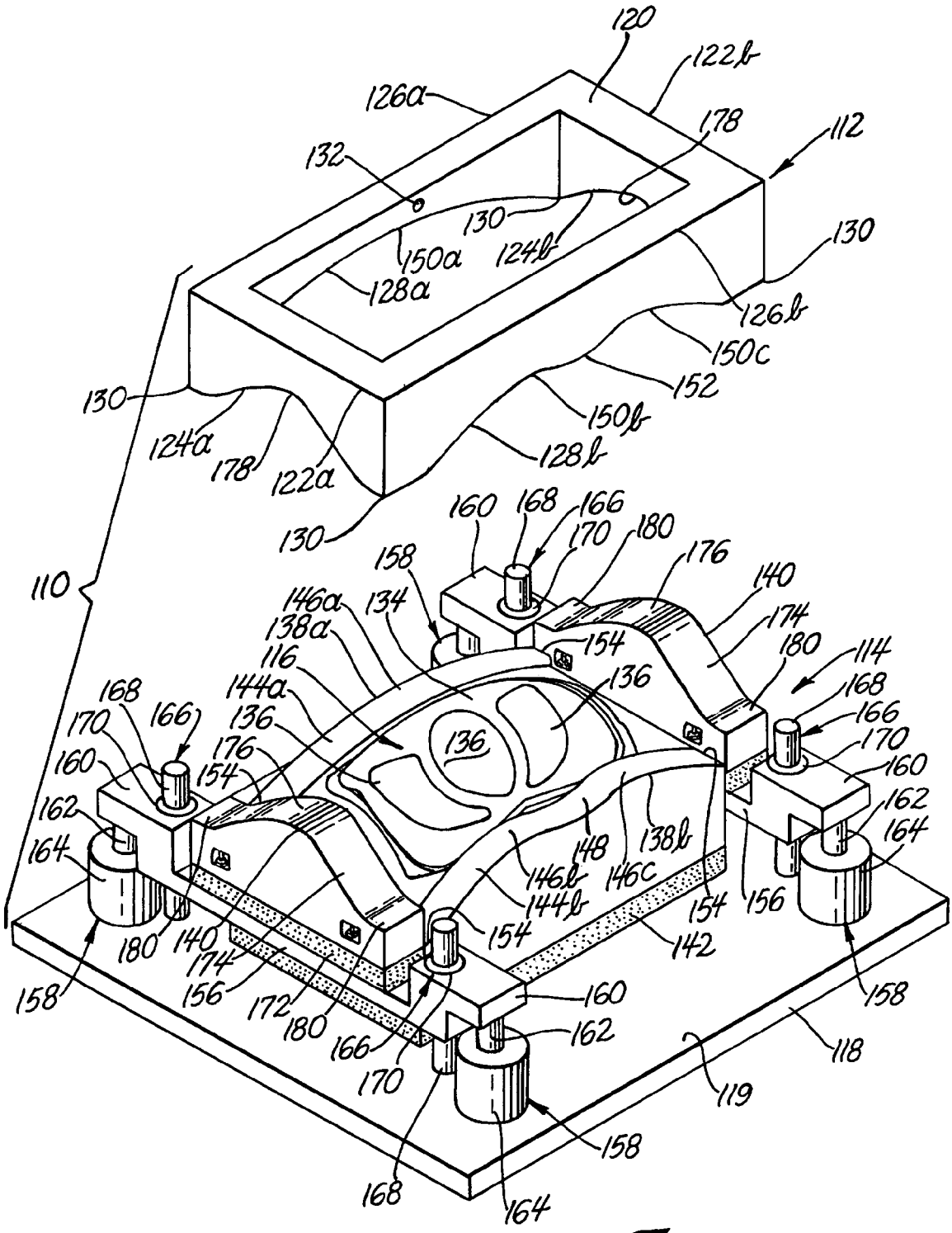
FIG. 2 illustrates a hot stretch-forming apparatus in accordance with the present invention.

Referring now in detail to the drawing figures, FIG. 2 illustrates a hot stretch-forming apparatus 110 in accordance with the present invention, including a rectangular upper tool or binder 112, a four-sided lower tool or binder apparatus 114 mounted generally vertically opposed to and below the upper binder 112 for clamping a two-dimensional sheet metal blank (not shown) therebetween, and a form die 116 that is substantially circumscribed by portions of the lower binder apparatus 114 and that is provided for forming an impression of itself on the sheet metal blank to produce a three-dimensional component (not shown). The hot stretch-forming apparatus 110 is adapted for use within a press (not shown), which has an upper ram for driving the upper binder 112 in a downward direction toward the lower binder apparatus 114 and form die 116. The press also has a lower platen 118 for supporting the lower binder apparatus 114 and form die 116 on an upper surface 119 thereof.

The upper binder 112 is essentially an upper die or pressure flask that has an upper surface 120 adapted for mounting to a flat upper platen of a press (not shown) and that has electrical heating elements (not shown) therein for maintaining a desired forming temperature of the sheet metal blank, which is usually pre-heated. The upper binder 112 is preferably mounted on a load bearing insulation layer (not shown) and a sub plate (not shown) that is attached to the upper platen (not shown). The upper binder 112 includes laterally opposed ends 122*a*, 122*b* with contoured lower binder surfaces 124*a*, 124*b* and further includes laterally opposed sides 126*a*, 126*b* with contoured lower binder surfaces 128*a*, 128*b*. Corners 130 of the upper binder 112 are adapted for initial contact with a sheet metal blank (not shown) to be formed. A port 132 is provided through one of the sides 126*a* to communicate pressurized gas into a cavity defined by the upper platen of the press, the upper binder 112, and an upper surface of the sheet metal blank when the tools are in their closed position. The upper binder 112 is driven by the upper platen of the press in a direction toward the lower binder apparatus 114 and the form die 116.

The form die 116 is preferably fixedly mounted to the upper surface of the lower platen 118 with a layer of insulation (not shown) positioned therebetween. The form die 116 includes a generally convex upper surface 134 having various structural design features 136 therein for embossing or otherwise forming the sheet metal blank. Alternatively, the form die 116 could be movably mounted to the lower platen 118 to provide double-action motion for forming the sheet metal blank. In any event, the form die 116 is generally circumscribed by the lower binder apparatus 114.

The lower binder apparatus 114 basically includes laterally opposed stationary binder segments or sides 138*a*, 138*b* on either side of the form die 116, and laterally opposed movable binder segments or ends 140, 140 on either end of the form die 116. The binder segments 138*a*, 138*b*, 140, 140 closely circumscribe the form die 116, and are spaced from the form die 116 according to dimensions that are consistent with current one-piece binders known in the art. Uniquely, however, the binder segments 138*a*, 138*b*, 140, 140 are contoured, positioned, and mounted in a manner which is heretofore unknown in the art.

The stationary binder sides 138*a*, 138*b* are mounted to the upper surface 119 of the lower platen 118 with a layer of insulation 142 therebetween. The stationary binder sides 138*a*, 138*b* are generally rectangular in shape, but have contoured upper binder surfaces 144*a*, 144*b* that preferably, but not necessarily, conform closely with sides of the form die 116 that are relatively proximate the stationary binder sides 138*a*, 138*b*. The contoured upper surfaces 144*a*, 144*b* have convex crest portions 146*a*, 146*b*, 146*c* that represent the peak in height of the stationary binder sides 138*a*, 138*b*. One of the stationary binder sides 138*b* has a depression 148 formed in the contoured upper surface 144*b* that follows a particular contour of the form die 116. To complement the contoured upper surfaces 144*a*, 144*b* of the stationary binder sides 138*a*, 138*b*, the upper binder 112 is similarly contoured. The sides 126*a*, 126*b* of the upper binder 112 include the contoured lower surfaces 128*a*, 128*b* that have concave crest portions 150*a*, 150*b*, 150*c* that substantially match the respective convex crest portions 146*a*, 146*b*, 146*c* of the stationary binder sides 138*a*, 138*b*. Likewise, one of the sides 126*b* includes a projection 152 that closely complements the depression 148 of one of the stationary binder sides 138*b*. Thus, due to the complementary contours, when the upper binder 112 eventually closes down on the stationary binder sides 138*a*, 138*b*, the sheet metal blank gets clamped therebetween in a substantially uniform sealing manner. Moreover, seal beads (not shown) may be provided on the lower surfaces 124*a*, 124*b*, 128*a*, 128*b* of the upper binder 112 to further enable sealing in this regard. Finally, the contoured upper surfaces 144*a*, 144*b* of the stationary binder sides 138*a*, 138*b* include laterally opposed end portions, or shoulders 154, against which the movable binder ends 140, 140 abut.

The movable binder ends 140, 140 are mounted to the upper surface 119 of the lower platen 118 via cradles 156. The cradles 156 are supported and biased in an upward direction by cushion devices 158 positioned under flange portions 160 of the cradles 156. The cushion devices 158 include pistons 162 that are mounted within cylinders 164, which may be gas, hydraulic, spring, or the like. In any event, the cushion devices 158 provide the means by which the cradles 156 are elevated with respect to the upper surface 119 of the lower platen 118. The cushion devices 158, however, do not support the cradles 156 in a lateral direction. Accordingly, alignment devices 166 are mounted between the upper surface 119 of the lower platen 118 and the flange portions 160 of the cradle 156 to support the cradle 156 in a lateral direction and maintain the cradles 156 in precise relation to the stationary binder sides 138*a*, 138*b* and the form die 116 such that a predetermined gap is controlled therebetween. The alignment devices 166 include guide posts 168 that are mounted to the upper surface 119 of the lower platen 118 and are fitted within bearing sleeves 170 that are press fit into the flange portions 160 of the cradles 156. The alignment devices 166 may be any type of bearing device such as a linear bearing assembly and the like.

The movable binder ends 140, 140 are mounted to the cradles 156 with a layer of insulation 172 therebetween. The movable binder ends 140, 140 are generally rectangular in shape, but have contoured upper binder surfaces 174 that preferably, but not necessarily, conform closely with ends of the form die 116 that are relatively proximate the movable binder segments. The contoured upper surfaces 174 have convex crest portions 176 that represent the peak in height of the movable binder ends 140. To complement the contoured upper surfaces 174 of the movable binder ends 140, the upper binder 112 is similarly contoured. The ends 122*a*, 122*b* of the upper binder 112 include the contoured lower surfaces 124*a*, 124*b* that have concave crest portions 178 that substantially match the respective convex crest portions 176 of the movable binder ends 140. Thus, when the upper binder 112 closes down on the movable binder ends 140, the sheet metal blank gets clamped therebetween in a substantially uniform sealing manner. Again, seal beads (not shown) may be provided on the lower surfaces 124*a*, 124*b*, 128*a*, 128*b* of the upper binder 112 to further enable sealing in this regard. Finally, the contoured upper surfaces 174 of the movable binder ends 140 include laterally opposed end portions, or shoulders 180, against which the ends 154 of the stationary binder segments abut 138*a*, 138*b*. Accordingly, the crest portions 176 and shoulders 180 of the movable binder ends 140 are relatively elevated with respect to the crest portions 146*a*, 146*b*, 146*c* and ends 154 of the stationary binder sides 138*a*, 138*b*, to enable sequential clamping or locking of the sheet metal blank between the upper binder 112 and the lower binder apparatus 114, as will be described in more detail below with regard to the method of the present invention.

Figure 3A:
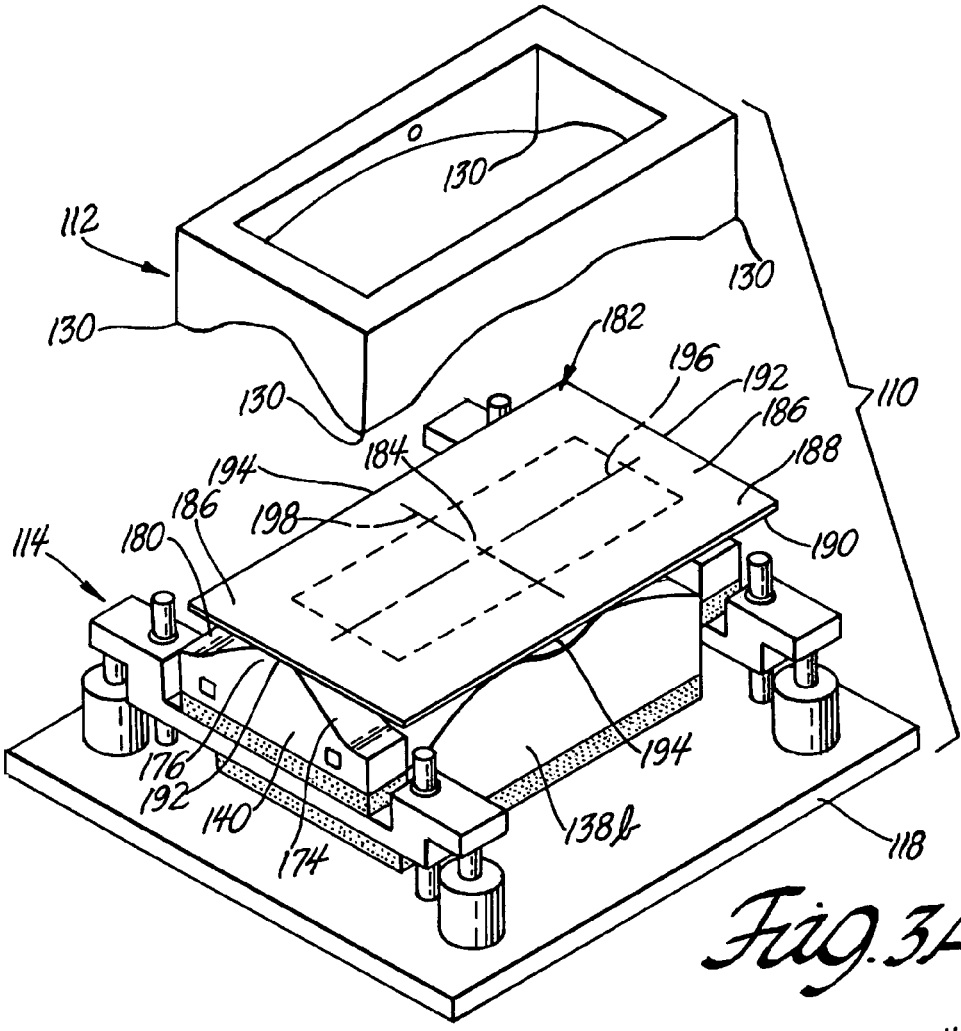
FIG. 3A illustrates the hot stretch-forming apparatus of FIG. 2 being used to form a flat sheet of material in accordance with a method of the present invention.

The method of the present invention is illustrated in reference to FIGS. 3A through 3D. Referring now to FIG. 3A, a blank sheet 182 of material may be preheated to its desired forming temperature and then be placed between the upper and lower binders 112, 114. In the discussion below, many of the elements of the die apparatus 110 may be obscured from view by the blank sheet 182. Therefore, in the discussion below FIG. 2 may be referenced in addition to FIGS. 3A–3D. The blank sheet 182 may be loaded atop the crest portions 176 of the movable binder ends 140 or may be initially elevated with respect thereto. The blank sheet 182 may be loaded manually or automatically, and may be held in place with the aid of a gravity-operated blank loading device (not shown) such as that described in U.S. Pat. No. 6,085,571, which is assigned to the assignee hereof and is incorporated by reference herein. The blank sheet 182 may be steel, titanium, or polymeric material, but is preferably an aluminum alloy such as AA5083 for hot stretch-forming. In any case, the blank sheet 182 is substantially two-dimensional in that it is generally planar or flat with no substantial three-dimensional projections provided therein. The blank sheet 182 is sized such that a central portion 184 thereof is centered over the form die and a marginal portion or area 186 thereof extends over the contoured upper surfaces 144*a*, 144*b*, 174 of the lower binder apparatus 114. The blank sheet 182 has an upper surface 188, a lower surface 190, ends 192, sides 194, a longitudinal axis 196 along its length, and a transverse axis 198 perpendicular to the longitudinal axis 196. The blank sheet 182 may be in contact with the contoured upper surfaces 174 of the movable binder ends 140 or may be initially elevated with respect thereto.

When the blank sheet 182 is in place, the binders 112, 138*a*, 138*b*, 140, the form die 116, and the blank sheet 182 itself may be heated such as by electrical resistance elements (not shown), to maintain a desired QPF temperature such as about 500 degrees C. in the forming environment. An upper ram of the press (not shown) then slowly drives or lowers the upper binder 112 toward the lower die platen 118 such that the lower corners 130 of the upper binder 112 engage respective corners in the marginal area 186 of the blank sheet 182. The upper binder 112 continues its downward travel so as to drive the blank sheet 182 downward so that the lower surface 190 of the blank sheet 182 initially engages the crest portions 176 of the contoured upper surfaces 174 of the movable binder ends 140. At this point in the process, the movable binder ends 140 remain in their upwardly biased position, elevated with respect to the stationary binder sides 138*a*, 138*b*.

Figure 3B:
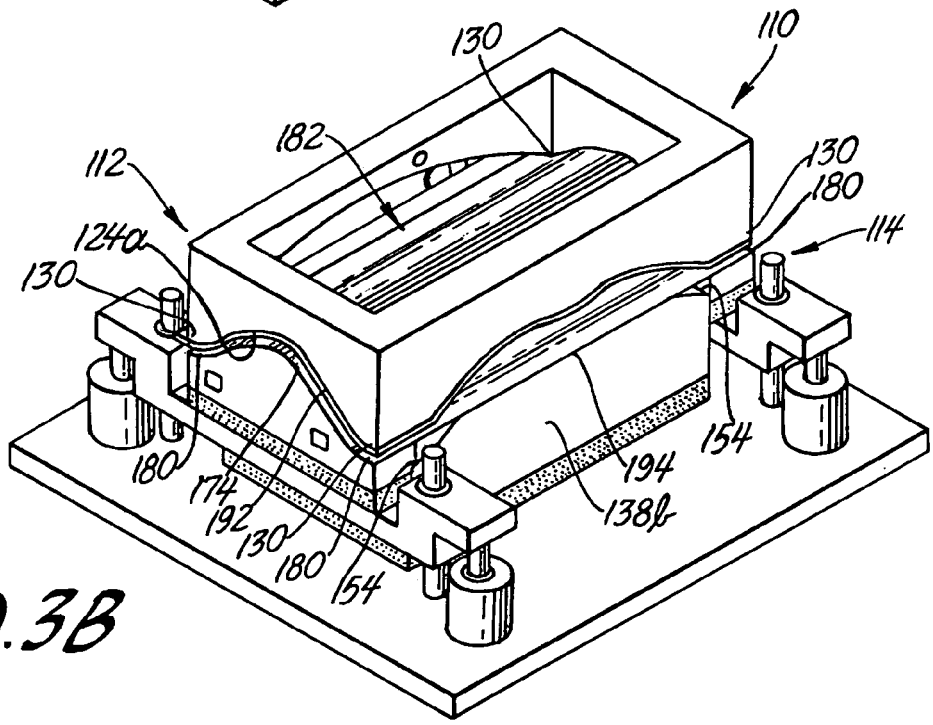
FIG. 3B illustrates the hot stretch-forming apparatus of FIG. 3A wherein the flat sheet of material is being partially formed over a portion of the apparatus in accordance with the method of the present invention.

Referring now to FIG. 3B, the upper binder 112 continues to be driven downwardly by the upper ram of the press (not shown) so as to bend the blank sheet 182 about its longitudinal axis 196 (shown in FIG. 3A) until the lower corners 130 of the upper binder 112 drive the respective corners of the blank sheet 182 into initial engagement with the shoulders 180 of the movable binder ends 140. Accordingly, the ends 192 of the blank sheet 182 are bent into conformity between the complementary contoured surfaces 124*a*, 124*b*, 174. The sides 194 of the blank sheet 182, however, remain straight because the sides 194 have not yet been formed over the stationary binder sides 138*a*, 138*b*. At this point in the process, the sides 194 of the blank sheet 182 may be in initial engagement with the crest portions 146*a*, 146*b*, 146*c* of the contoured upper surfaces 144*a*, 144*b* of the stationary binder sides 138*a*, 138*b* or may be elevated with respect thereto. Note, however, that the shoulders 180 of the movable binder ends 140 remain elevated with respect to the ends 154 of the stationary binder sides 138*a*, 138*b*. Thus, FIG. 3B represents the first stage of a sequence of forming the blank sheet 182 over the lower binder apparatus 114.

Figure 3C:
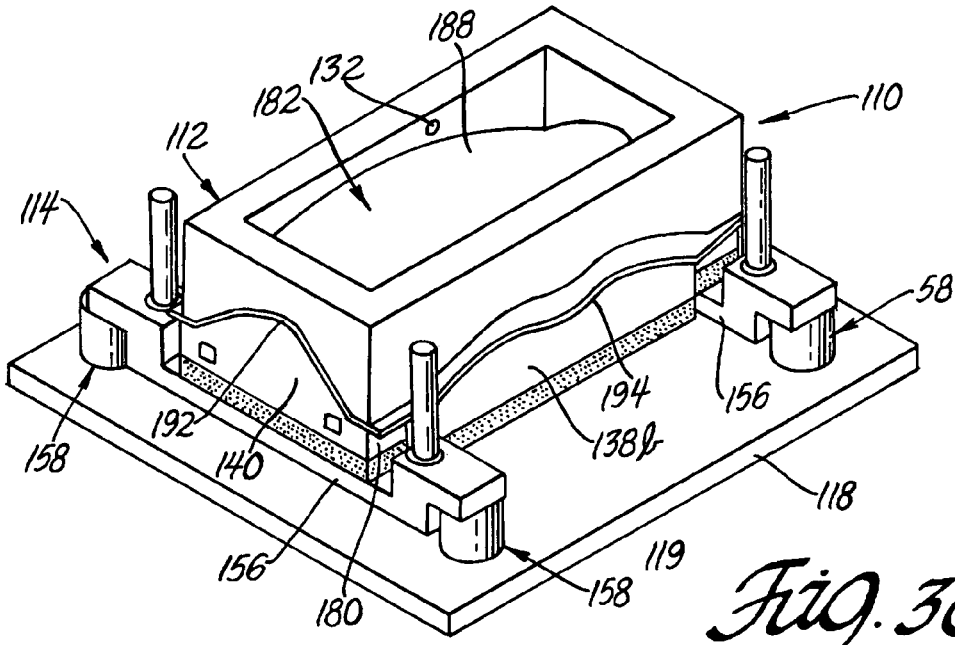
FIG. 3C illustrates the hot stretch-forming apparatus of FIG. 3B wherein the flat sheet of material is being further formed over another portion of the apparatus and is also being super-plastically formed in accordance with the method of the present invention.

FIG. 3C represents the second stage of that sequence. The upper binder 112 continues its downward travel, so as to bend the blank sheet 182 about its transverse axis 198 (shown in FIG. 3A). Continued downward travel of the upper binder 112 will overcome the upward bias force provided by the cushion devices 158 and thus will displace the movable binder ends 140 and cradles 156 until the cradles 156 bottom out on the upper surface 119 of the lower platen 118 or at least until the shoulders 180 of the movable binder ends 140 are in substantial elevational alignment with the ends 154 of the stationary binder sides 138*a*, 138*b*. Accordingly, the margins at the sides 194 of the blank sheet 182 are bent into conformity between the complementary contoured surfaces 128*a*, 128*b*, 144*a*, 144*b*. At this point in the process, the blank sheet 182 is fully clamped about its marginal area 186 between the upper binder 112 and lower binder apparatus 114.

With full closure of the binders 112, 114, the blank sheet 182 is gripped in gas-tight sealing engagement via the lockbeads (not shown) on the upper binder 112. Accordingly, high pressure gas may be admitted against the upper surface 188 of the blank sheet 182 through the port 132 in the upper binder 112, or upper platen, or the like in accord with customary practice in the art. Concurrently, gas may be vented from the opposite side of the blank sheet 182 through similar suitable ports (not shown), as is also known in the art. Thus, the high temperatures and gas pressure combine to stretch the blank sheet 182 into compliance with the contoured convex surfaces 134 of the form die 116.

Figure 3D:
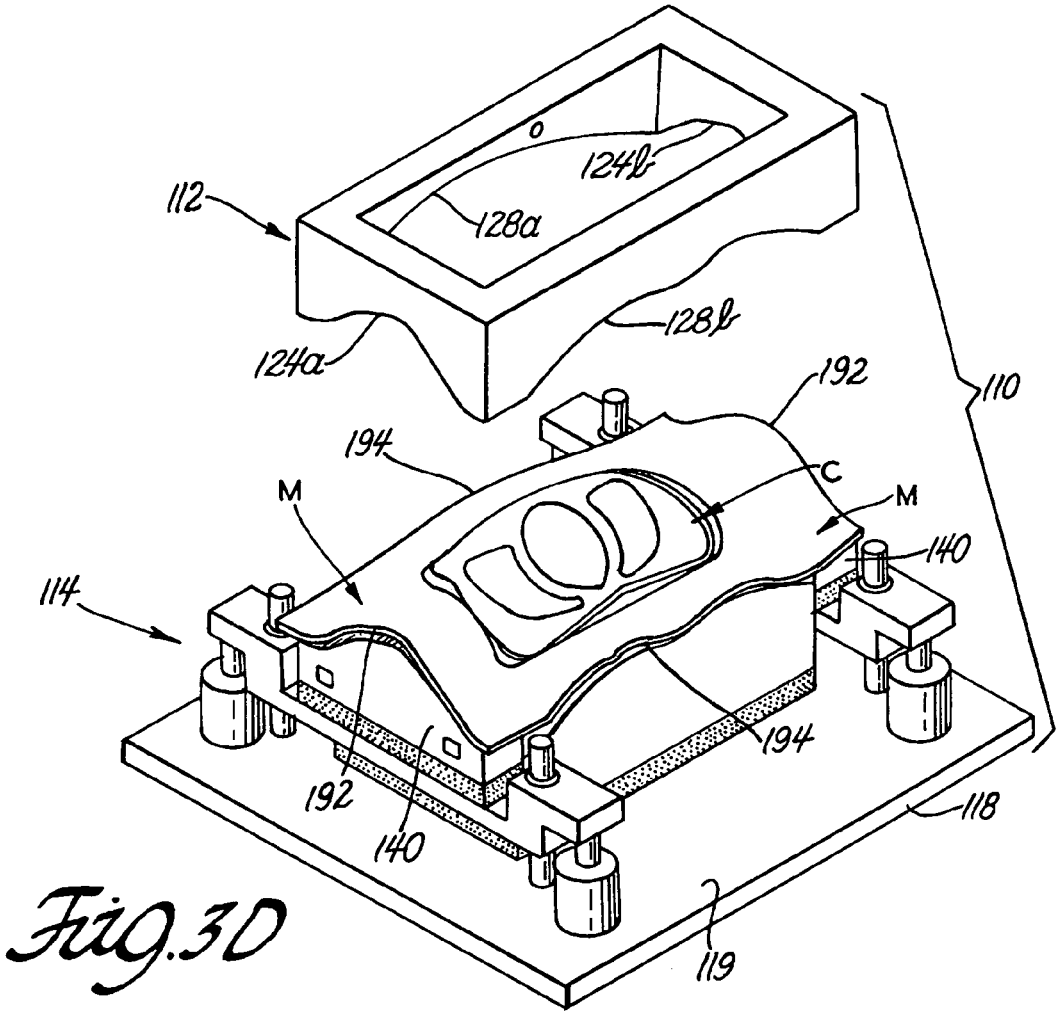
FIG. 3D illustrates the hot stretch-forming apparatus of FIG. 3C wherein the flat sheet of material has been completely formed by the apparatus in accordance with the method of the present invention.

FIG. 3D illustrates the completion of the process. Here, the upper binder 112 has been retracted, by raising the upper platen of the press. As can be seen, the sheet metal blank of FIG. 3A has been formed into a formed three-dimensional component C with a scrap margin M therearound. Also, the sides 194 and ends 192 of the sheet 182 are bent into substantial conformity with the contoured surfaces 124*a*, 124*b*, 128*a*, 128*b* of the binders 112, 114.

The sheet metal blank 182 was sequentially clamped, first between ends 124*a*, 124*b*, 140 of opposed binders 112, 114 about a first axis 196, and then between sides 128*a*, 128*b*, 144*a*, 144*b* of the opposed binders 112, 114 about a second axis 198 transverse to the first axis 196. Accordingly, the sheet metal blank 182 is preformed in a compound manner to avoid wrinkling thereof during the forming process, which minimizes wrinkling in the finished component C.

Thinning and wrinkling defects can be avoided by implementing a more complex forming process, wherein a pre-forming stage defines a suitable pre-formed panel shape with relatively even thinning behavior and further wherein the panel is situated against the final forming surface in such a way to guarantee a wrinkle-free final forming process. The pre-forming stage or operation can be achieved by a stamping method or hot gas blow forming. With respect to tool design, the punch can be the only moving element for stretching the blank, or the binder ring can be designed to move around a stationary punch, with an identical effect as the moving punch concept. The functionality of the ring can be substantially increased if the ring is provided in separate sections to enable a sequence of stretching operation to achieve an optimum pre-formed panel shape.

It should be understood that the invention is not limited to the embodiments that have been illustrated and described herein, but that various changes may be made without departing from the spirit and scope of the invention. For example, the present invention could be adapted for use in traditional steel sheet metal stamping if the movable binder segments incorporated a lock bead to control blank draw in. Likewise, the present invention may also be adapted for use in plastic sheet forming. Moreover, the present invention has been described in reference to generally rectangular binders, but is equally applicable to binders of any shape including square, circular, oblong, and the like. Finally, words of orientation such as upper and lower have been used herein to set forth an example of the present invention, but should not be construed as limiting the present invention. In other words, the present invention can be carried out in any orientation. Accordingly, it is intended that the invention not be limited to the disclosed embodiments, but that it have the full scope permitted by the language of the following claims.

The invention claimed is:

1. A method of forming a component from a sheet material blank, said method comprising:

placing said sheet material blank between a first binder and a second binder apparatus, said second binder apparatus having stationary binder segments and further having movable binder segments that are movable with respect to said stationary binder segments, said second binder apparatus circumscribing a form die having a forming surface for the forming of said sheet material;

moving said first binder toward said second binder apparatus to initially bend said sheet material blank into substantial conformity with said movable binder segments of said second binder apparatus; and further moving said first binder so as to displace said movable binder segments, thereby subsequently bending said sheet material blank into substantial conformity with said stationary binder segments of said second binder apparatus, and thereby bending said sheet material blank over said forming surface of said a form die.

2. The method as recited in claim 1, further comprising:

pre-heating said sheet material blank to a superplastic forming temperature before said placing step; and applying fluid pressure against an upper surface of said sheet material blank to hot blow form said sheet material blank over said forming surface of said form die.

3. The method as recited in claim 1, wherein said moving step includes providing said movable binder segments with contoured surfaces having substantially similar shapes.

4. The method as recited in claim 3, wherein said further moving step includes providing said stationary binder segments with contoured surfaces having dissimilar shapes.

5. A binder apparatus for minimizing wrinkling in the forming of a substantially three-dimensional component from a substantially two-dimensional blank, said binder apparatus comprising:

laterally opposed stationary binder segments; and movable binder segments that are movable with respect to said stationary binder segments, said movable binder segments being mounted to at least one cradle supported by at least two alignment devices and upwardly biased by at least two cushion devices.

6. The binder apparatus as recited in claim 5, wherein each of said movable binder segments are individually mounted to two separate cradles so as to be individually movable with respect to one another.

7. The binder apparatus as recited in claim 5, wherein said movable binder segments are biased in an upward direction with respect to said laterally opposed stationary binder segments.

8. The binder apparatus as recited in claim 7, wherein said stationary binder segments include crest portions and said movable binder segments include end portions that are elevated with respect to said crest portions when said movable binder segments are substantially fully elevated with respect to said stationary binder segments.

9. The apparatus as recited in claim 5, wherein said contoured surfaces of said stationary binder segments are dissimilar.

10. The apparatus as recited in claim 5, wherein said contoured surfaces of said movable binder segments are substantially similar.

11. A forming apparatus for minimizing wrinkling in the forming of a substantially three-dimensional component from a substantially two-dimensional blank, said forming apparatus comprising:

a first binder adapted for clamping said blank;

a form die mounted in opposed relation with respect to said first binder; and a second binder apparatus adapted for clamping said blank and substantially circumscribing said form die, said second binder apparatus comprising:

stationary binder segments; and movable binder segments that are movable with respect to said stationary binder segments.

12. The forming apparatus as recited in claim 11, wherein said movable binder segments are mounted to at least one cradle supported by at least two alignment devices and upwardly biased by at least two cushion devices.

13. The forming apparatus as recited in claim 12, wherein each of said movable binder segments are individually mounted to separate cradles so as to be individually movable with respect to one another.

14. The forming apparatus as recited in claim 11, wherein said movable binder segments are biased in a direction toward said first binder.

15. The forming apparatus as recited in claim 14, wherein said movable binder segments are elevated with respect to said stationary binder segments.

16. The apparatus as recited in claim 11, wherein said stationary binder segments have contoured surfaces that are dissimilar from one another.

17. The apparatus as recited in claim 11, wherein said movable binder segments have contoured surfaces that are substantially similar.

18. A sheet material forming apparatus comprising:

a first binder having a first set of laterally opposed sides and a second set of laterally opposed sides, said first and second sets having binder surfaces thereon; and a second binder mounted in opposed facing relationship to said first binder, said second binder having a first set of laterally opposed sides that have binder surfaces that are substantially complementary in shape to said binder surfaces of said first set of laterally opposed sides of said first binder, said second binder further having a second set of laterally opposed sides that have binder surfaces that are substantially complementary in shape to said binder surfaces of said second set of laterally opposed sides of said first binder;

wherein said binder surfaces of said first sets of said first and second binders have substantially similar contours and further wherein said second sets of said first and second binders have different contours and wherein one of said first and second sets of said second binder are movable with respect to the other of said first and second sets of said second binder.

* * * * *